US011312171B1

(12) United States Patent
Smith, Jr.

(10) Patent No.: US 11,312,171 B1
(45) Date of Patent: Apr. 26, 2022

(54) CAN GRAPHICS CONCEALMENT THROUGH PIGMENTED OVERVARNISH

(71) Applicant: Richard Raymond Smith, Jr., Arvada, CO (US)

(72) Inventor: Richard Raymond Smith, Jr., Arvada, CO (US)

( * ) Notice: Subject to any disclaimer, the term of this patent is extended or adjusted under 35 U.S.C. 154(b) by 0 days.

(21) Appl. No.: 17/373,458

(22) Filed: Jul. 12, 2021

(51) Int. Cl.

| | |
|---|---|
| ***B41M 1/40*** | (2006.01) |
| ***B41M 1/28*** | (2006.01) |
| ***B05D 1/26*** | (2006.01) |
| ***B05D 1/28*** | (2006.01) |
| ***B05D 7/22*** | (2006.01) |
| ***B41M 7/02*** | (2006.01) |
| ***B65D 1/12*** | (2006.01) |
| ***B65D 65/42*** | (2006.01) |
| ***B65D 25/34*** | (2006.01) |
| ***B67C 3/02*** | (2006.01) |
| ***B67C 3/26*** | (2006.01) |

(Continued)

(52) U.S. Cl.

CPC ..... *B41M 7/02* (2013.01); *B05D 1/26* (2013.01); *B05D 1/28* (2013.01); *B41M 1/28* (2013.01); *B41M 1/40* (2013.01); *B65B 39/00* (2013.01); *B65B 39/02* (2013.01); *B65D 1/12* (2013.01); *B65D 25/34* (2013.01); *B65D 65/42* (2013.01); *B67C 3/02* (2013.01); *B67C 3/26* (2013.01); *B05D 7/227* (2013.01); *B05D 2202/25* (2013.01); *B05D 2259/00* (2013.01)

(58) Field of Classification Search

None

See application file for complete search history.

(56) References Cited

U.S. PATENT DOCUMENTS

| | | | |
|---|---|---|---|
| 3,714,770 | A | 2/1973 | Rothke |
| 3,937,350 | A | 2/1976 | Völker |

(Continued)

FOREIGN PATENT DOCUMENTS

| | | | | |
|---|---|---|---|---|
| CN | 101372274 | A | | 2/2009 |
| CN | 105966740 | A | | 9/2016 |
| JP | 09165501 | A | * | 6/1997 |

OTHER PUBLICATIONS

"Shrink Sleeve Cans," https://www.kaufmancontainer.com/shrink-sleeve-labeled-cans/, downloaded Jul. 8, 2021.

(Continued)

*Primary Examiner* — William P Fletcher, III

(74) *Attorney, Agent, or Firm* — Stiennon & Stiennon

(57) ABSTRACT

Overvarnished aluminum cans which are not usable because of label graphic errors or other reasons are conditioned for reuse by first treating the existing overvarnish to accept an opaque new layer of overvarnish. The opening of the can is engaged with a plug having a pin communicating with a pressurized gas supporting the can on a wheel to supply gas pressure according to the rotational position of the pin. The overvarnished can is pressurized to allow printing an opaque new layer of overvarnish on to the can over the existing overvarnish. The treated can is visually inspected and the internal coating resprayed, and the opaque overvarnish and the internal coating are cured in a final curing oven, the can being then ready for printing of new graphics or sold as a brite, silver or blank can where other graphics can be applied.

20 Claims, 3 Drawing Sheets

(51) Int. Cl.
*B65B 39/00* (2006.01)
*B65B 39/02* (2006.01)

(56) References Cited

U.S. PATENT DOCUMENTS

| | | | | |
|---|---|---|---|---|
| 10,442,564 | B2 | 10/2019 | Ojima et al. | |
| 2018/0170031 | A1* | 6/2018 | Vella | B41F 3/54 |
| 2020/0055081 | A1* | 2/2020 | Kingston | B05D 5/04 |
| 2020/0406426 | A1 | 12/2020 | Bao et al. | |

OTHER PUBLICATIONS

U.S. Environmental Protection Agency, "Preliminary Industry Characterization: Metal Can Manufacturing—Surface Coating", Research Triangle Park, NC 27711, Sep. 1998.

* cited by examiner

1/3

20
22
24
25
26
28
30
32
34
46
48
50
52
58
60
64
68
76
78
80
82
84

CAN GRAPHICS CONCEALMENT THROUGH PIGMENTED OVERVARNISH

CROSS REFERENCES TO RELATED APPLICATIONS

Not applicable.

STATEMENT AS TO RIGHTS TO INVENTIONS MADE UNDER FEDERALLY SPONSORED RESEARCH AND DEVELOPMENT

Not applicable.

BACKGROUND OF THE INVENTION

The present invention relates to full overcoating of fully formed and unused aluminum cans with external printed graphics to conceal existing graphics.

The aluminum can is a ubiquitous form of consumer packaging. About 180 billion aluminum cans are made every year or over 20 cans for every person an earth. The cost of making an aluminum can is about 10 cents and its value as scrap is about 1 cent. A certain percentage of aluminum cans are scrapped before filling because of a misprinted graphic, a graphic which has been changed, or cans with a graphic which were overproduced. The billions of cans made each year means that even a low scrap rate for cans that could be reused, is a loss of substantial value.

Alternatively, it is known to produce cans without printed external graphics which are sold as "brite or silver" cans. Such cans are covered with preprinted shrink sleeves or pressure adhesive labels. Such procedures can be costly and present a different appearance. What is needed is a method for treatment of preprinted aluminum cans to allow their reuse with new graphics with a similar appearance to a conventional can.

SUMMARY OF THE INVENTION

The method of this invention allows a fully formed, labeled via inks and coatings and overvarnished aluminum can which is not usable because of label graphic errors, graphic changes, or overproduction, etc. to be conditioned for reuse. The process for reconditioning aluminum cans includes treating the existing overvarnish on the can's external surface to accept an opaque overvarnish. The can may be secured to undergo the process through several methods which support the integrity of the can walls while undergoing treatment. In one method of securement, an expandable elastomeric plug is extended within the narrowed open end of the can and is expanded to grip the inner wall of the can neck. The elastomeric plug incorporates a pin with a gas supply passageway which leads to a gas supply manifold. The pin supports the can on a wheel which contains the gas manifold arranged to supply gas pressure according to the rotational position of the pin. Before or after the treating with the overvarnish, the can is pressurized to make the can rigid so the opaque pigmented overvarnish can be transferred from a printing roll surface onto the cylindrical portion of the can over the existing overvarnish. Following the application of the opaque overvarnish, it is dried or partly cured in an oven. The recoated can surface is then machine inspected to detect any defects in the opaque overvarnish. Following inspection, the internal can coating may optionally be resprayed and the can passed through a final cure oven.

It is an object of the present invention to provide a process for reusing preprinted aluminum cans which have not yet been filled or used for other purposes.

Further objects, features and advantages of the invention will be apparent from the following detailed description when taken in conjunction with the accompanying drawings.

DESCRIPTION OF THE PREFERRED EMBODIMENTS

Figures 1A, 1B, 2:
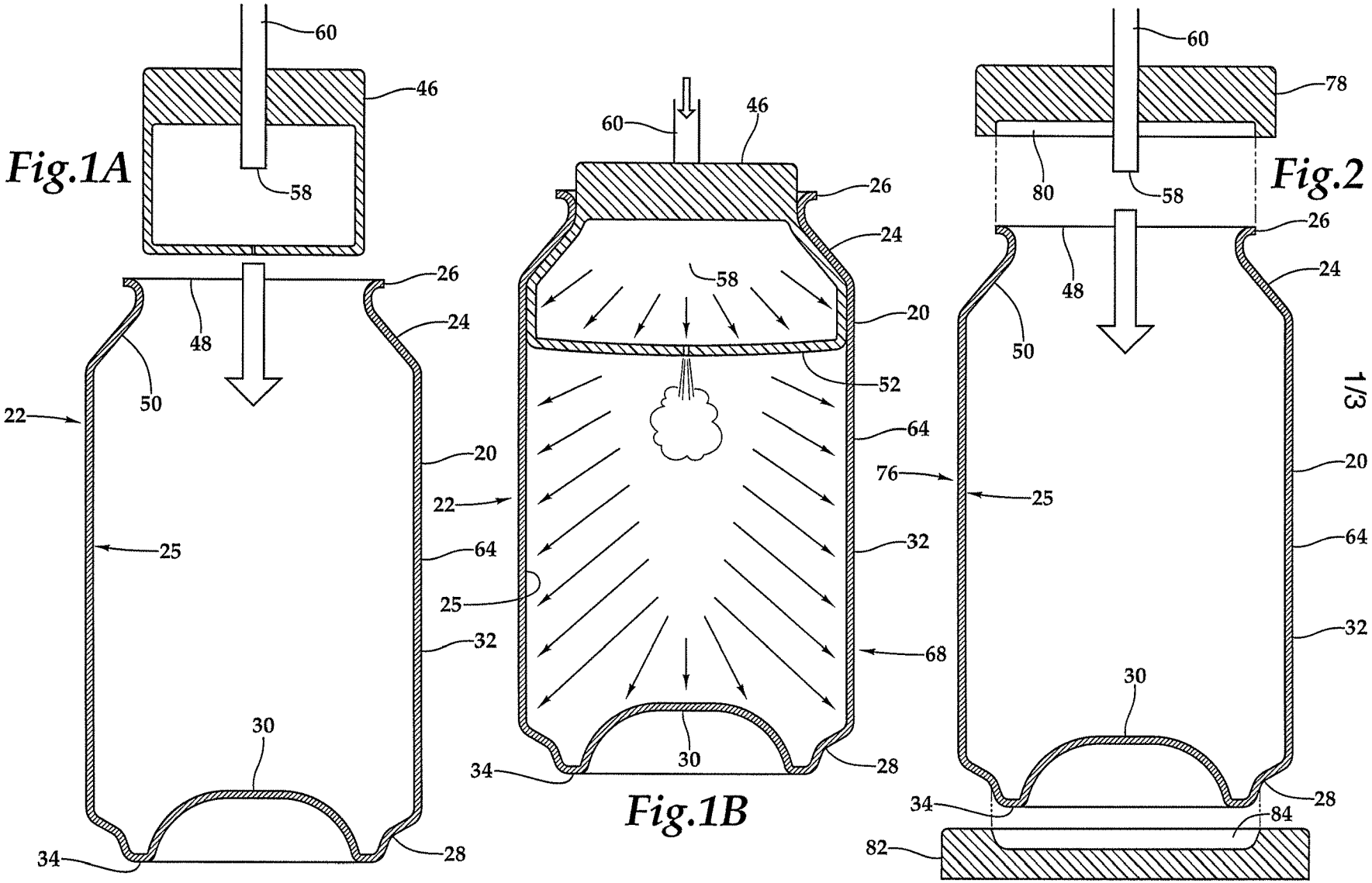
FIG. 1*a* is a cross-sectional view of an aluminum can showing the insertion of an uninflated elastomeric plug, a part of which forms a gas bladder which is inflatable.
FIG. 1*b* is a cross-sectional view of the aluminum can of FIG. 1 showing the elastomeric plug with the gas bladder inflated with compressed air.
FIG. 2 is a cross-sectional view of an alternative can securement arrangement in which upper and lower fixtures engage the can base and upper perimeter.

Referring more particularly to FIGS. 1-6, wherein like numbers refer to similar parts, a conventional aluminum beverage can 22 is shown in FIGS. 1*a* and 1*b*. Manufacturing the body 20 of an aluminum beverage can 22 involves forming a cylindrical 21 wall of the can from an aluminum blank by successive drawings, printing a label graphic 23 on the outside of the can, coating the metal insides 25 of the can 22, and forming a neck 24 terminating at a flange 26 used to from a double seamed closure with a can top (not shown). The formed can body 20 further has a bottom 28 including a concave dome 30, and cylindrical sidewalls 32. A ring of varnish is applied to a protruding ring 34 of the concaved dome 30 on the bottom 28 of the can so the can will slide on conveyor belts during manufacturing and in vending machines. The can exterior surfaces 37 are printed such as by offset printing with multiple color inks to create graphics 23 indicating its contents and as point of sale branding and advertising. An overvarnish 40 is applied over the graphic to protect the graphics and enhance its appearance. The inks and varnish are hardened in an oven or, if the inks and varnish are UV curable, the inks are hardened in a UV oven. The can interior surfaces 25 are spray coated, typically with an epoxy resin, to protect the interior aluminum surface from the can's contents and all coatings are heat or UV cured. After the can is printed and coated interiorly, a neck 26 is formed which narrows the can wall so as fit a lid (not shown) which is smaller in diameter than the can cylinder. The upper edge of the neck 26 is formed into an outward extending circular flange 26 with a width of about 0.1 inch which is used to join the can body 20 via a double seamed clamp to the can lid after the can is filled.

The finished can is typically placed on pallets and shipped to the customer to be filled and joined to the lids supplied from a separate manufacturing process. If at this point or later it is determined that the can will not be used due to a label graphic error, graphic change, or overproduction, etc. the process disclosed herein is used to conceal the existing coatings so the cans may be reused by applying a new graphic to the exterior of the can.

By the process of this invention, a fully formed, labeled and overvarnished aluminum can which is not usable because of label graphic errors, graphic changes, or over production, etc. is conditioned for reuse.

The preparation of the existing coatings to accept the concealment coating is accomplished by processes which render the existing overvarnish receptive such that an opaque overvarnish 40 will adhere. Known processes to modify the surface of the original overvarnish include: heat, plasma, abrasion, and application of a chemical such as a solvent or an etchant.

The overvarnish on the can external surface may be treated to accept the opaque overvarnish 40 by heating the existing varnish in in an oven 42 or with a flame for a short period to change the surface properties of the overvarnish. Other possibilities include plasma cleaning typically in a low pressure oven by using oxygen and/or argon to oxidize the outer layer of the polymer, cleaning the overvarnish and increasing polar groups on the surface to improve the printability of the surface. UV irradiation of the can surface, or abrasion are other possibilities.

Before or after treating the overvarnish to accept an additional overvarnish, the can is pressurized in the range of 1-90 psi gauge to make the can rigid so an overvarnish can be transferred from a printing roll 44 or belt surface on to the cylindrical portion 21 of the can 22. At the same time or subsequently a secondary roll or belt is arranged to engage the tapered surface of the neck of the can. The applied overvarnish is preferably water based and is opaque typically by employing a titanium dioxide (the mineral rutile) having a particle size of 0.2-0.3 microns for maximum light scattering effect.

The pressurized can 22 is then sufficiently rigid to accept offset printing. Pressurizing the can may be accomplished by several mechanisms. In the embodiment shown in FIGS. 1*a* and 1*b* an expandable elastomeric plug 46 which fits within the open end 48 of the can and, is inserted and expanded to grip the inner wall 50 of the can neck 24. The elastomeric plug has a plug part which forms a gas bladder 52. Prior to inflation, the gas bladder is small enough to fit through the narrow open end 48 of the can, as shown in FIG. 1*a*. Once inserted within the can, as shown in FIG. 1*b*, the gas bladder 52 is inflated to engage the interior can wall. FIG. 1*b* shows how the gas first inflates the bladder 52 then as pressure is increased gas passed into the can inside 25 below the plug 46.

In the embodiment 76 of FIG. 2, a securement arrangement is used having an plug 78 which is a movable first fixture which may be elastomeric and which has a cavity 80 which fits the upper flange profile of the can. The can is retained within a bottom cup 82 which has an opening 84 which receives the lower profile of the can and serves as a second fixture. The plug 78 and bottom cup 82 travel to engage the can. The pin 60 then introduces gas pressure into the can while sealed by the upper fixture. The lower fixture 82 while retaining the can against the upper fixture 78 also prevents pigmented overvarnish from being applied to the dome and lower surface of the can.

Figure 4:
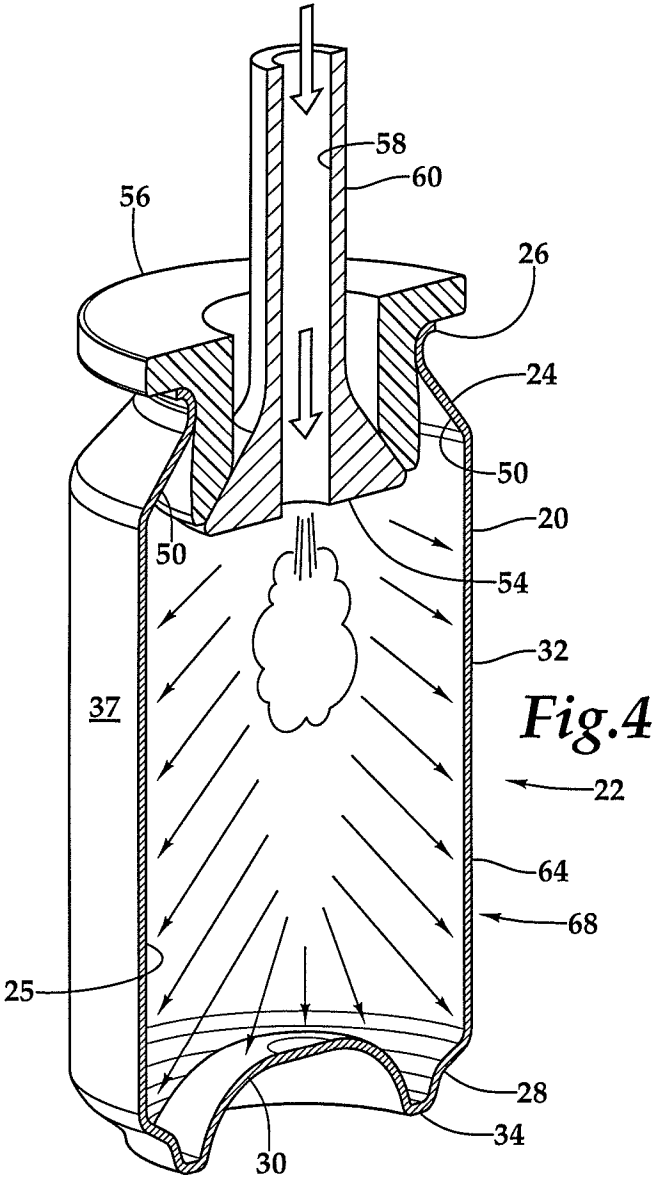
FIG. 4 is an isometric cross-sectional view of the arrangement of FIG. 3, where the elastomeric plug is mechanically engaged with aluminum can neck interior surface and the can is pressurized to receive an opaque overcoat.
Figure 3:
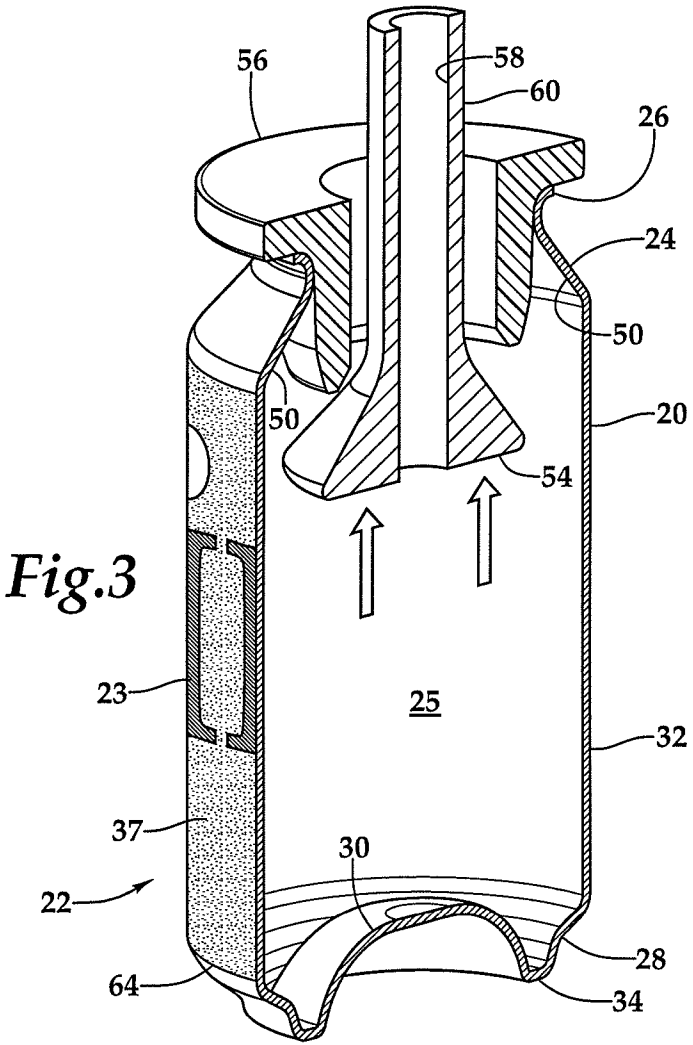
FIG. 3 is an isometric cross-sectional view of an alternative embodiment of the elastomeric plug of FIG. 1 where the elastomeric plug includes a reciprocating structure which forces the elastomeric plug into engagement with aluminum can neck interior surface.
Figure 5:
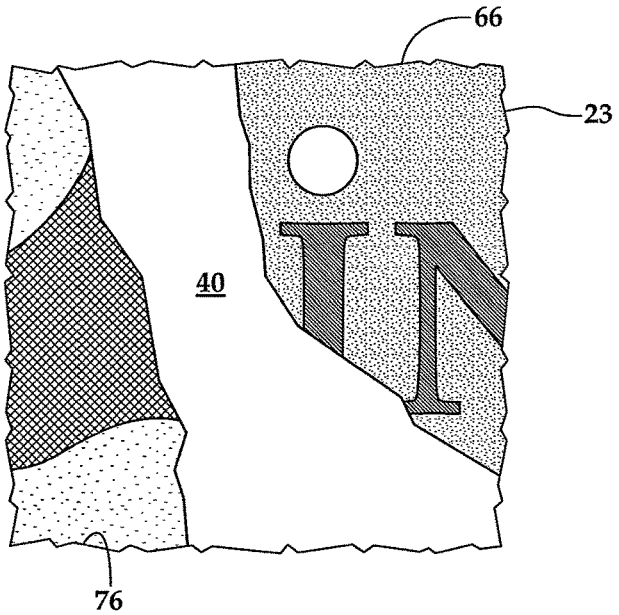
FIG. 5 is a fragmentary side elevational view of the can of FIG. 4, partially broken away in section to show the layers of coatings applied to the reused can.
Figure 6:
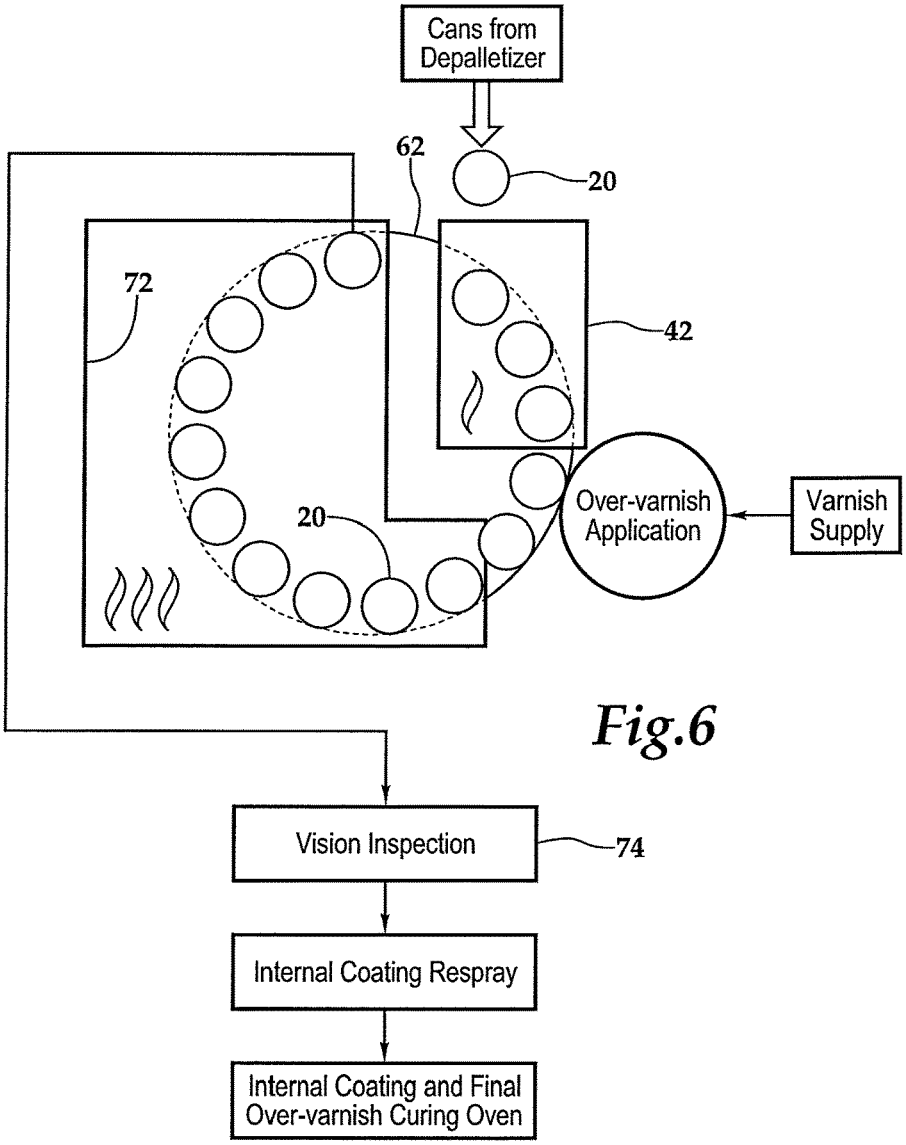
FIG. 6 is a schematic view of the steps of the process for applying an overcoating to a preprinted unfilled aluminum can.

Other can plugs could include a elastomeric plug having an expanding collet within the elastomeric plug, or using mechanical compression of the elastomeric plug in a direction perpendicular to the can opening causing the elastomeric plug to expand to engage the inside neck walls. Alternatively, as shown in FIGS. 3 and 4, the can is engaged by movement of a tapered inner plug 54 within the elastomeric plug 56 which extends perpendicular to the can opening to compress the elastomeric plug and cause it to expand outwardly to engage the inside neck walls 50. The elastomeric plug 56 incorporates a gas supply passageway 58 which leads to a gas supply manifold (not shown). The gas passageway is in a pin 60 which supports the can on a wheel 62, as indicated in FIG. 6. The gas manifold (not shown) and valves (not shown) within the wheel 62 control filling of the interior volume of the can 22 with gas which rigidifies the can cylindrical wall 21. The can 22 thus mounted to the wheel 62 is rotated into an oven 42 which heats the exterior cylindrical surface 64 of the can, thereby conditioning the existing coating 66 on the can to receive an opaque overvarnish, as shown in FIG. 5. After the existing overvarnish is conditioned to accept an opaque overvarnish the cans are moved to engage the transfer roll 44 or belt which applies the pigmented overvarnish by offset printing to the exterior 64 of the pressurized can 68, thereby hiding the existing coatings 66 and label graphic 23. Following application, the opaque overvarnish 40 is dried or partly cured in an overvarnish curing oven 72 of modest temperature. The cans then pass through a known and existing vision system 74 which images the inside and exterior of the can and detects any flaws which require the can to be recycled. Following inspection the internal coating is resprayed, and interior coating and outer coating are cured in a final cure oven. The cans may then be provided with graphics by various processes, for example using shrink sleeves or adhesive labels, or if the cans are pressurized e.g., as shown in FIGS. 1A-2, they may be printed with new graphics 76, as shown in FIGS. 5 and 6. Shrink wrapped, printed or unprinted cans may be repalletized and shipped.

It should be noted that the cans treated in this process may be reprinted by offset printing or other printing techniques, including digital inkjet printing.

It is understood that the invention is not limited to the particular construction and arrangement of parts herein illustrated and described, but embraces all such modified forms thereof as come within the scope of the following claims.

I claim:

1. A method of overcoating a fully formed aluminum can with a neck and a flange at an open end, the can being printed with an existing exterior graphic which is coated with an existing overvarnish, the method comprising the steps of:

treating the can existing overvarnish to accept an opaque overvarnish;

moving a plug to engage the can open end, the plug having a passageway which communicates with a source of gas;

pressurizing the can from the source of gas through the passageway in the plug to a pressure of 1-90 psig to rigidify the can cylindrical wall to withstand further processing;

printing the can cylindrical wall with an opaque overvarnish to hide the existing exterior graphic on the can;

curing the opaque overvarnish; and wherein the can has an interior, and further comprising the steps of:

drying the opaque overvarnish at a first temperature; and recoating the interior of the can and curing the opaque overvarnish at a second temperature higher than the first temperature.

2. The method of claim 1 wherein the plug is an elastomeric member having an air bladder to expand the elastomeric plug to engage the can neck.

3. The method of claim 1 wherein the plug is an elastomeric member and is expanded by movement of a tapered second plug within the plug axially to cause expansion of the plug perpendicular to the movement of the second plug to engage the plug with the can opening.

4. The method of claim 1 wherein the open end of the can communicates with a can interior, the can having a cylindrical wall further comprising the steps of:

treating the overvarnish to accept an opaque overvarnish;

moving the plug to engage the can open end and sealing the plug against the can, the plug passageway therethrough in communication with the source of pressurized gas;

connecting the source of pressurized gas through the passageway in the plug to the interior of the can, to thereby rigidify the can cylindrical wall to withstand offset printing;

engaging a printing roll or belt and applying the opaque overvarnish to hide the existing exterior graphic on the can; and curing the applied opaque overvarnish.

5. The method of claim 1 wherein the fully formed aluminum can with a neck and a flange and an open end further comprises an exterior cylindrical surface adjoining a conical neck surface wherein at least a substantial majority of said cylindrical surface and said conical neck surface are covered with a first colored ink layer, a transparent overvarnish layer on the first colored ink layer, and an opaque overvarnish layer on the transparent overvarnish layer.

6. The method of claim 5 further comprising covering the opaque overvarnish layer by a second colored ink layer, and covering the second colored ink layer by a second transparent overvarnish.

7. The method of claim 1 further comprising covering the opaque overvarnish layer by a second colored ink layer, and covering the second colored ink layer by a second transparent overvarnish.

8. The method of claim 1 wherein the step of pressurizing the can from the source of gas through the passageway in the plug is to a pressure of 10-90 psig.

9. The method of claim 1 wherein the opaque overvarnish is rendered opaque by titanium dioxide particles which are 0.2-0.3 microns in size.

10. A method of overcoating a fully formed aluminum can with a neck and a flange at an open end, the can being printed with an existing exterior graphic which is coated with an existing overvarnish, the method comprising the steps of:

treating the can existing overvarnish to accept an opaque overvarnish;

moving a plug to engage the can open end, the plug having a passageway which communicates with a source of gas;

pressurizing the can from the source of gas through the passageway in the plug to a pressure of 1-90 psig to rigidify the can cylindrical wall to withstand further processing;

printing the can cylindrical wall with an opaque overvarnish to hide the existing exterior graphic on the can;

curing the opaque overvarnish;

wherein the plug is an elastomeric member positionable within the neck and having an expanding collet to expand the elastomeric plug.

11. The method of claim 10 further comprising covering the opaque overvarnish layer by a second colored ink layer, and covering the second colored ink layer by a second transparent overvarnish.

12. The method of claim 10 wherein pressurizing the can from the source of gas through the passageway in the plug to a pressure of 10-90 psig.

13. The method of claim 10 wherein the opaque overvarnish is rendered opaque by titanium dioxide particles which are 0.2-0.3 microns in size.

14. A method of overcoating a fully formed aluminum can with a neck and a flange at an open end, the can being printed with an existing exterior graphic which is coated with an existing overvarnish, the method comprising the steps of:

treating the can existing overvarnish to accept an opaque overvarnish;

moving a plug to engage the can open end, the plug having a passageway which communicates with a source of gas;

pressurizing the can from the source of gas through the passageway in the plug to a pressure of 1-90 psig to rigidify the can cylindrical wall to withstand further processing;

printing the can cylindrical wall with an opaque overvarnish to hide the existing exterior graphic on the can;

curing the opaque overvarnish;

wherein the plug is an elastomeric member positionable within the neck and wherein the plug is subjected to mechanical axial compression to cause a perpendicular expansion of the plug to extend against the can opening.

15. The method of claim 14 further comprising covering the opaque overvarnish layer by a second colored ink layer, and covering the second colored ink layer by a second transparent overvarnish.

16. The method of claim 14 wherein pressurizing the can from the source of gas through the passageway in the plug to a pressure of 10-90 psig.

17. The method of claim 10 wherein the opaque overvarnish is rendered opaque by titanium dioxide particles which are 0.2-0.3 microns in size.

18. A method of overcoating a fully formed aluminum can with a neck and a flange at an open end, the can being printed with an existing exterior graphic which is coated with an existing overvarnish, the method comprising the steps of:

treating the can existing overvarnish to accept an opaque overvarnish;

moving a plug to engage the can open end, the plug having a passageway which communicates with a source of gas;

pressurizing the can from the source of gas through the passageway in the plug to a pressure of 1-90 psig to rigidify the can cylindrical wall to withstand further processing;

printing the can cylindrical wall with an opaque overvarnish to hide the existing exterior graphic on the can;

curing the opaque overvarnish;

wherein the can has a lower profile which is closed and is positioned opposite the can open end, and wherein the step of moving a plug to engage the can open end, comprises moving the plug to engage the flange of the can within a cavity in the plug, and to engage the lower wall of the can with a bottom cup which has an opening to receive the lower profile of the can.

19. The method of claim 18 further comprising covering the opaque overvarnish layer by a second colored ink layer, and covering the second colored ink layer by a second transparent overvarnish.

20. The method of claim 18 wherein pressurizing the can from the source of gas through the passageway in the plug to a pressure of 10-90 psig.

* * * * *